US006328546B1

(12) United States Patent
Kishi et al.

(10) Patent No.: US 6,328,546 B1
(45) Date of Patent: Dec. 11, 2001

(54) SCREW COMPRESSOR WITH ADJUSTABLE FULL-LOAD CAPACITY

(75) Inventors: Takayuki Kishi; Toshio Nishio, both of Tokyo (JP)

(73) Assignee: Mayekawa Mfg., Ltd., Tokyo (JP)

( * ) Notice: Subject to any disclaimer, the term of this patent is extended or adjusted under 35 U.S.C. 154(b) by 0 days.

(21) Appl. No.: 09/463,660

(22) PCT Filed: Jun. 1, 1998

(86) PCT No.: PCT/JP98/02417

§ 371 Date: Apr. 7, 2000

§ 102(e) Date: Apr. 7, 2000

(87) PCT Pub. No.: WO99/63229

PCT Pub. Date: Dec. 9, 1999

(51) Int. Cl.[7] ..... F04C 18/16
(52) U.S. Cl. ..... 418/201.3

(58) Field of Search ..... 418/201.3

(56) References Cited

FOREIGN PATENT DOCUMENTS 54-39209 * 3/1979 (JP) ..... 418/201.3
56-12092 2/1981 (JP) .
57-27317 6/1982 (JP) .

* cited by examiner

*Primary Examiner*—John J. Vrablik
(74) *Attorney, Agent, or Firm*—Crowell & Moring LLP

(57) ABSTRACT

A screw-compressor of which the full-load capacity can be adjusted without changing the shape, number of components and basic dimensions of the compressor, wherein the outer circumferential area of teeth above the pitch circle of the intake side end of the male rotor is eliminated stepwise to a prescribed angle of rotation to form an airflow rate reducing section and a bypass leading to the intake port is provided.

1 Claim, 5 Drawing Sheets

SCREW COMPRESSOR WITH ADJUSTABLE FULL-LOAD CAPACITY

FIELD OF THE INVENTION

The present invention relates to a screw compressor with adjustable full-load capacity of which the capacity adjustment of the screw compressor that compresses working fluids by engaging a male rotor and a female rotor within a casing is enabled in a wide range.

PRIOR ART

Conventionally, a non-step capacity adjustment by a slide valve system is used to adjust the capacity of a screw compressor. The slide valve system is a method of which a part of the gas sucked into the rotor is returned to the suction room via a slide valve during the compression process. Since this method is integrated to the compressor as part of the system, although the method is useful in respect to being equipped with a system which enables a change in the capacity after the compressor is produced, there is a problem of which the efficiency of compression (isothermal efficiency/insulation efficiency) lowers as the air flow is adjusted to decrease.

Consequently, in order to achieve high compression efficiency while keeping the cost low, when performing an actual compression, a compressor in proportion to the necessary capacity is selected out of limited types of compressors. Therefore, rather than being based on safety, a compressor type of which the full-load capacity is slightly larger than the necessary capacity is selected.

However, in this case, since it is impossible to infinitely manufacture different types of compressors, a compressor type on the large side is inevitably selected. Thus a compressor is forced to operate in an intermittent manner, making the actual operation inefficient.

A capacity control depending on a slide system is also inefficient because the airflow is controlled by returning partway compressed gas to the intake side via a highly resistant bypass, necessitating an uneconomical recompression. Also, another factor that makes a capacity control depending on a slide system inefficient is that there is no practical change in the mechanical-loss even when the airflow decreases.

Meanwhile, as in the former case where many compressor types are prepared according to the necessary capacity, as an example, in order to prevent the airflow from increasing, it is necessary to shorten the length of the rotor. However, if the length of the rotor is shortened without changing the helix angle of the rotor, it is difficult to maintain a smooth rotation. Therefore, it was necessary to change the helix angle every time the rotor was shortened, causing problems in the cost of manufacture, as well as technological problems. As an attempt to take a measure against the above described problem, a proposal is disclosed in published Unexamined Japanese Patent Application No. Showa 56-12092.

The aforementioned proposal is shown in FIG. 7 (A), in which a notch 51 is provided so as to connect through space 52 with the teeth of the intake side end of the female rotor 50. Another embodiment of the proposal is shown in FIG. 7 (B), in which notch 56 is provided on alternate teeth of the male rotor 55, so as to connect through space 57 with the teeth of the intake side end, so as to obtain any capacity between 80~100%.

In the above described case, by delaying the starting position of compression of the male rotor (with 4 teeth) which starts at an angle of rotation of $\alpha°=0°$ to a maximum of $\alpha°=90°$, the capacity may be adjusted to a minimum of 80%. The degree of capacity between 80% and 100% is set by adjusting the passage resistance by changing the size of notch 51 or 56.

This method may be applied only to rotors which consist of an even number of teeth, and further, it is necessary to provide a notch on alternate teeth. Moreover, there exists a problem whereas the aforementioned capacity adjustment between 80% and 100% must be performed by a complicated adjusting means. That is, the capacity is adjusted by a passage resistance of the bypass which is controlled by the shape, size, etc. of the notch.

SUMMARY OF THE INVENTION

The present invention is made to resolve such ever existing problems, and its object is to offer a screw compressor with adjustable full-load capacity which enables an optional change of the capacity without changing the shape, number of components, basic dimensions, and basic specifications of the compressor.

The screw compressor according to the present invention utilizes a method of capacity adjustment of which was conventionally regarded as impossible, the method being enabled by suitably shortening the length of the rotors. Also, contrary to the conventional idea, the adjustment of capacity is performed without changing the helix angle.

That is, the degree of capacity is adjusted without changing the rotor diameter, the rotor length, the casing dimension, and the basic specifications of a drive power necessary for a full-load output of 100%, and by a slight after-process, it is made to be in proportion to the necessary capacity by a slight after-process.

Also, the originally set, preferable action ratio of the rotors is not changed by the after-process, and does not cause any inconvenience to the rotation.

Further, it is necessary to control the amount of sucked in airflow in order to control the capacity; however, it is also necessary for the sucked in airflow not to affect the process of compression after the capacity is adjusted.

Furthermore, it is necessary to provide a large bypass for returning working fluids to the intake side, so that the above described capacity control is not affected by a passage resistance.

Accordingly, the screw compressor with adjustable full-load capacity of the present invention is:

a screw compressor for compressing working fluids by engaging a male rotor and a female rotor within a casing, wherein an airflow rate reducing section is provided by eliminating a part of the rotor engagement of the screw rotor from the intake side end towards the direction of the shaft, and a bypass is provided for returning reduced airflow to the intake side, and the airflow rate reducing section and bypass is constructed so as to reduce the length of action of the screw rotors to correspond with the reduced capacity amount.

According to the above construction, by referring to the capacity percentage corresponding to the angle of rotation of the rotor, the angle of rotation in proportion to the reduced capacity percentage is set in advance. Then, the addendum of the rotor is eliminated from the intake side end of the rotor, until the corresponding angle of rotation is obtained, and the length of action of the rotors are reduced, while the bypass for returning reduced air to the intake side end is provided. Therefore, since the compression operation initiates only after the angle of rotation of the rotors pass the prescribed angle of rotation, theoretically, at the time of initiating compression, the tooth-space volume is smaller. Accordingly, compression power needed for a conventional capacity control method using a slide valve is unnecessary, and a capacity adjusted in proportion to the prescribed percentage of reduced airflow enables an efficient compression.

The airflow rate reducing section is formed stepwise on the outer circumferential section excluding the bottomland of the rotor, so as to serve as both an air flow rate reducing section and the bypass.

According to the above described construction, the airflow rate reducing section eliminates the outer circumferential section of teeth above the bottomland of the rotor in a stepwise manner, and since the center shaft portion including the pitch circle is left remaining, a smooth rotation is maintained, and a change of the helix angle is unnecessary.

Further, in an oil injecting type compressor, by eliminating a part of the tooth of the rotor, a loss due to oil agitation is decreased, reducing mechanical-loss. Furthermore, a large bypass towards the intake port is formed between the rotor shaft including the pitch circle nearby the bottomland and the inner surface of the casing, by providing an airflow rate reducing section formed by eliminating the teeth section of the rotor in a stepwise manner. Through the bypass, reduced airflow is easily returned to the intake port, so as to prevent any decrease in the efficiency due to this returning process.

The screw rotor is one of either the male or female rotor.

According to the above construction, only one of either the male/female rotor necessitates processing, and the component of which needs to be changed is only one of either the male/female rotor. Thus, a minimum number of components need to be changed.

Figure 1:
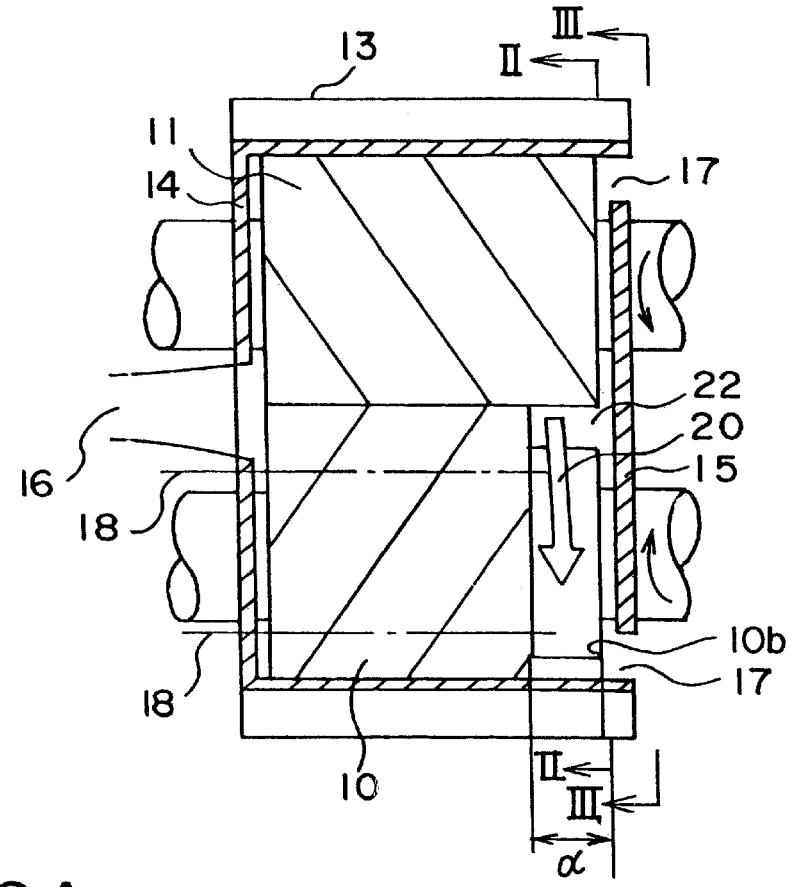
FIG. 1 is a schematic illustration wherein the circumference section of the casing is partially cutaway, showing the construction of the embodiment of a screw compressor with adjustable full-load capacity of the present invention.

7A is an illustration of a case in which the notch is provided on the female rotor, whereas

7B is an illustration of a case in which the notch is provided on the male rotor.

DETAILED DESCRIPTION OF THE PREFERRED EMBODIMENTS

Preferred embodiments of the present invention will now be described with reference to the accompanying drawings. It is intended, however, that dimensions, materials, and shapes of the constituent parts, relative positions thereof and the like in the following description and in the drawings shall be interpreted as illustrative only not as limitative of the scope of the present invention.

Figure 2A:
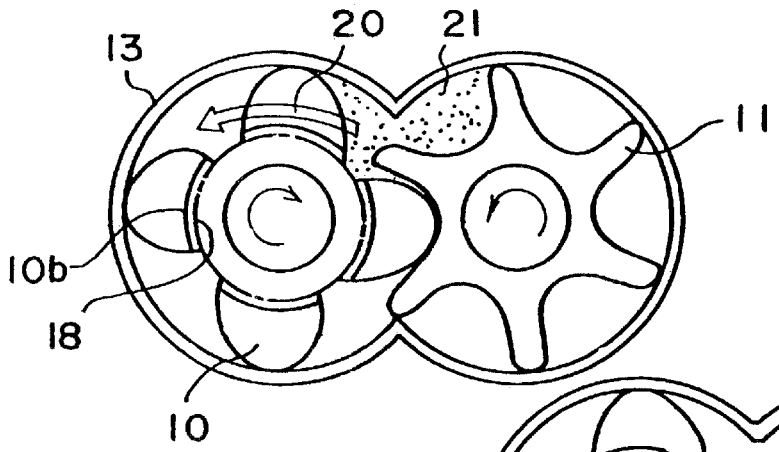
FIG. 2A is a sectional view taken along the line IIA—IIA of FIG. 1.
Figure 2B:
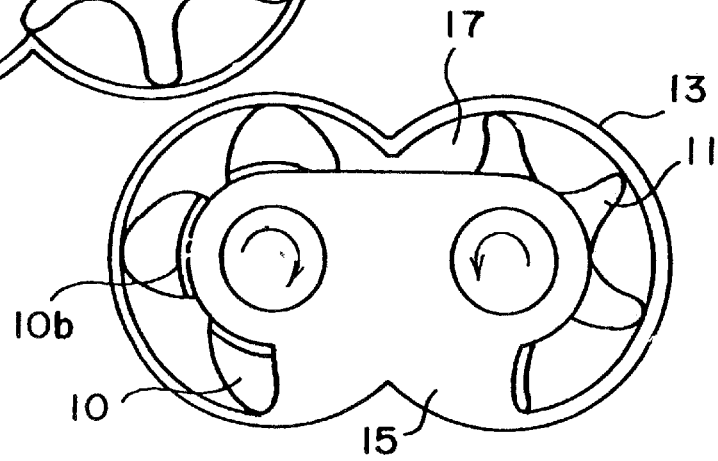
FIG. 2B is a sectional view taken along the line IIB—IIB of FIG. 1.
Figure 3:
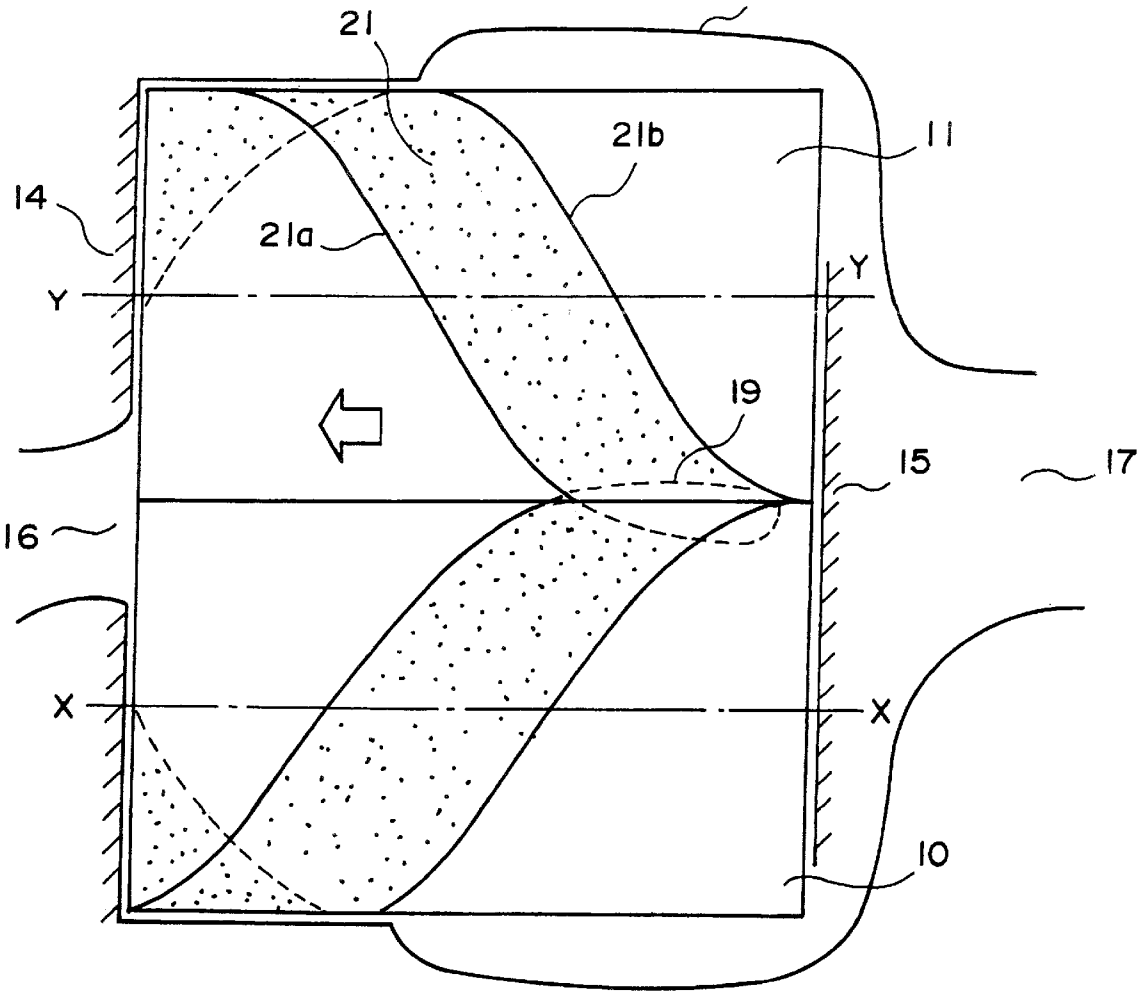
FIG. 3 is an illustration showing the tooth-space shifting with the rotor rotation at a capacity of 100%.
Figure 4:
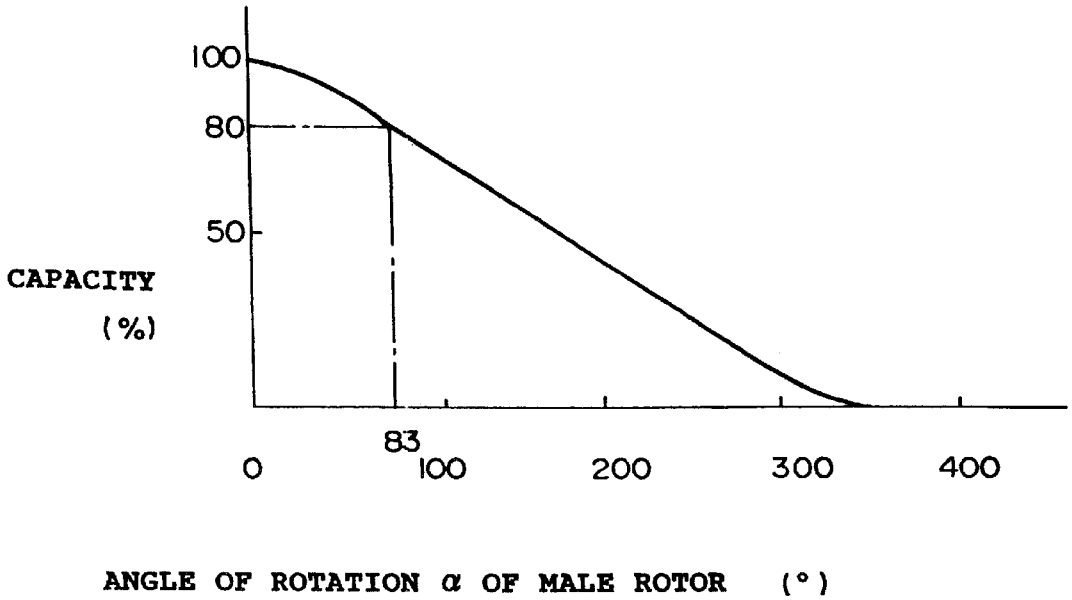
FIG. 4 is a graphical representation showing the relationship between the angle of rotation of the rotor and the capacity.
Figure 5:
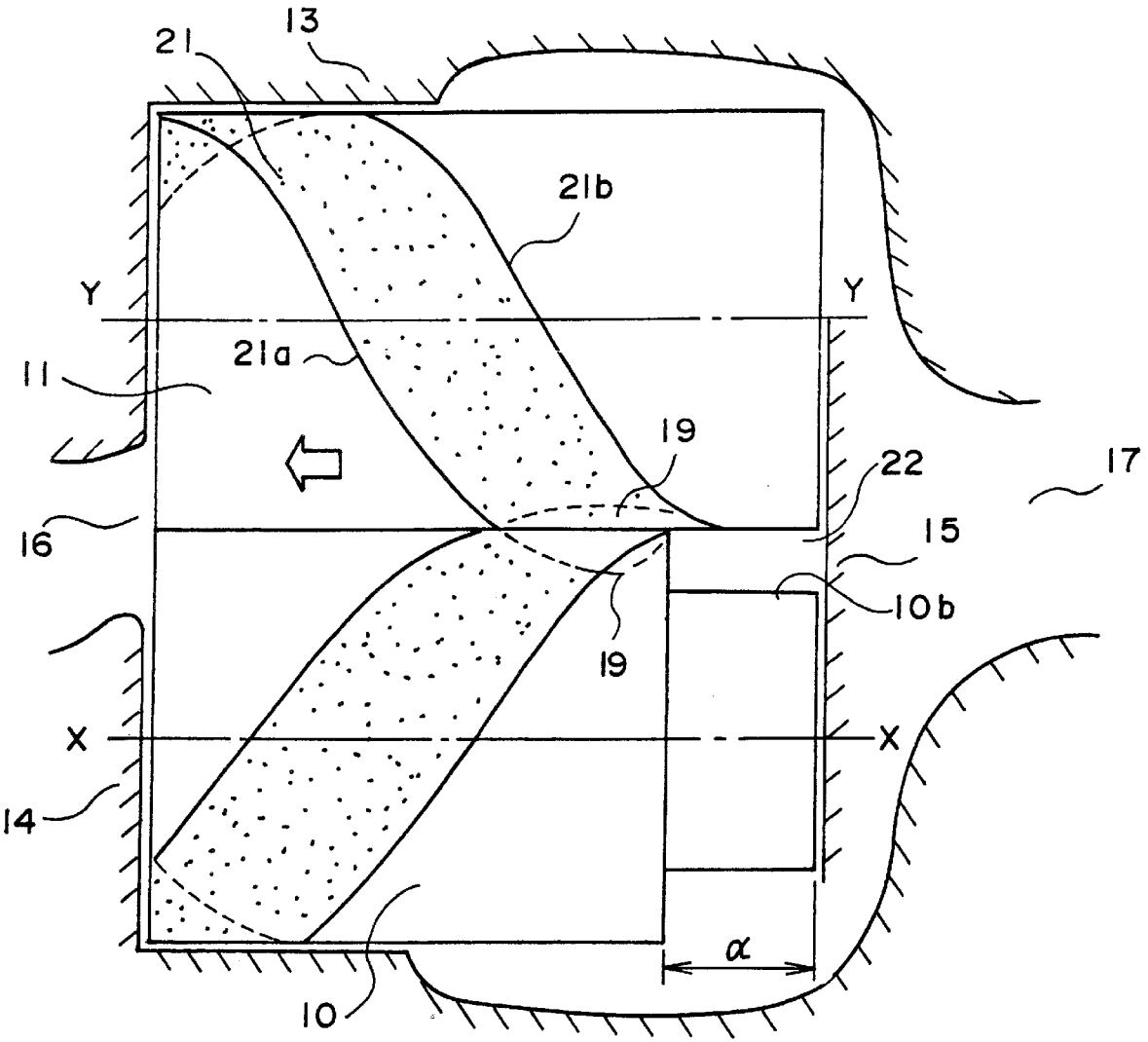
FIG. 5 is an illustration showing the tooth-space of which the rotor is adjusted to a capacity corresponding to the angle of rotation of $\alpha°$, at the time of initiating compression
Figure 6:
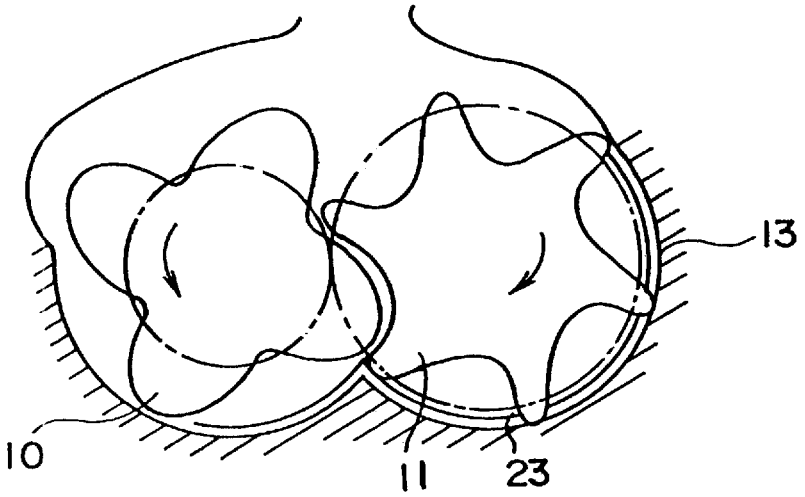
FIG. 6 is an illustration showing oil being agitated by the rotor of the screw compressor with adjustable full-load capacity of the present invention.
Figure 7A:
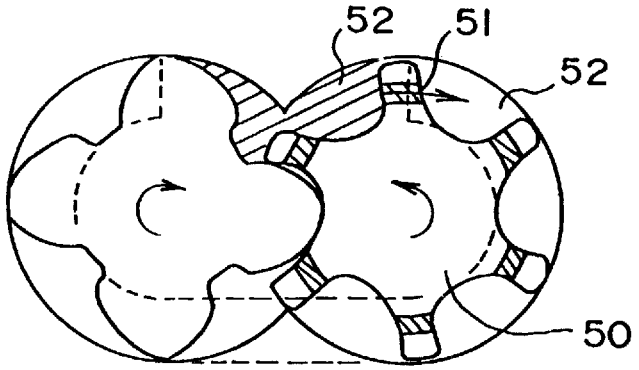
FIG. 7A PRIOR ART
FIG. 7 is an illustration showing the conventional method of capacity adjustment by providing a notch on the rotor.
Figure 7B:
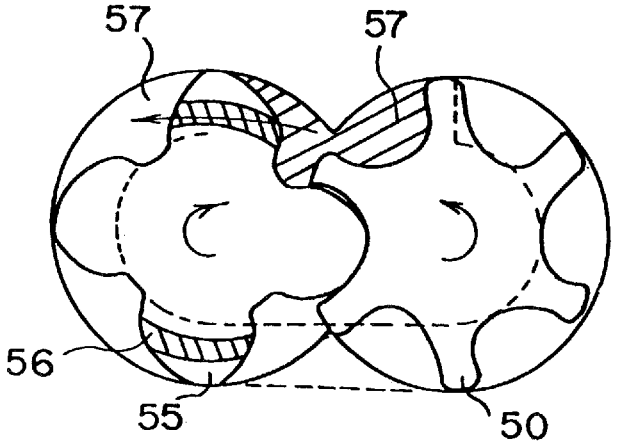
FIG. 7B PRIOR ART

FIG. 1 is a schematic illustration wherein the circumference section of the casing is partially cutaway, showing the construction of the embodiment of a screw compressor with adjustable full-load capacity of the present invention. FIG. 2A is a sectional view taken along the line IIA—IIA of FIG. 1, and FIG. 2B is a sectional view taken along the line IIB—IIB of FIG. 1. FIG. 3 is an illustration showing the tooth-space shifting with the rotor rotation at a capacity of 100%, and FIG. 4 is a graphical representation showing the relationship between the angle of rotation of the rotor and the capacity. FIG. 5 is an illustration showing the tooth-space of which the capacity is adjusted to 80%, at the time compression initiation. FIG. 6 is an illustration showing oil being agitated by the rotor of the screw compressor with adjustable load capacity of the present invention.

FIG. 1 is an illustration showing the construction of the compressor with adjustable full-load capacity. FIG. 1 shows the airflow rate reducing section of the compressor wherein the circumference section of the casing is partially cutaway, and the construction of the bypass which returns the reduced air flow to the intake port. In FIG. 2A, bypass 20 is shown in the sectional view taken along the line IIA—IIA of FIG. 1, and in FIG. 2B, the positional relationship between the intake side end 15 and the intake port is shown in the sectional view taken along the line IIB—IIB of FIG. 1.

As shown in FIG. 1, the compressor with adjustable full-load capacity of the present invention is constructed by providing an airflow rate reducing section which forms a capacity control function in a widely used screw compressor, and a bypass 20 which returns reduced air flow to the intake port.

The above described screw compressor may be a widely used, general-purpose screw compressor. That is, it is constructed of a male rotor 10 and a female rotor 11 having twisted teeth, and a casing which stores said pair of engaged male and female rotors in a virtually sealed state, with the exception of intake port 17 and discharge outlet 16. The casing consists of a circumference section 13, an intake side end 15, and a discharge side end 14, and a intake port 17 is provided on the intake side end 15, whereas a discharge outlet 16 is provided on the discharge side end 14.

According to the screw compressor of the present invention, the outer circumferential area above the pitch circle 18 of the intake side end 15 of the male rotor 10 is eliminated stepwise to an angle of rotation of $\alpha°$. Meanwhile, the air flow rate reducing section is formed stepwise by leaving the rotor part 10*b*, including the pitch circle 18 nearby the bottomland, remaining, and at the same time, bypass 20 to the intake port 17 becomes a circular space 22, formed between the rotor part 10*b* and outer circumference 13 of the casing.

When providing the air flow rate reducing section on the female rotor, because the pitch circle of the female rotor is close to the addendum, the outer circumferential area above the pitch circle (excluding the bottomland), is eliminated stepwise to an angle of rotation of $\alpha°$.

FIG. 3 is a view taken from below a surface which includes two rotor shafts X and Y, showing sealing lines 21*a* and 21*b* formed by the circumference of the female rotor II and the inner surface of the outer circumference section 13 of the casing, and also showing a tooth-space 21 denoted by a spotted section including a engaged rotor sealing-line 19. Sealing-lines 21*a* and 21*b*, and tooth-space 21 are included in an aforementioned screw compressor comprised of a male rotor 10 which has four teeth, and a female rotor 11 which has six teeth, at an helix angle of 300°. FIG. 3 shows a case in which the tooth-space 21 is at its full capacity (100%). Tooth-space 21 is shown by a section enclosed by sealing-lines 21*a* and 21*b*, formed by the circumference of the female rotor 11 and the inner surface of the circumference section 13 of the casing, and an engaged rotor sealing-line 19, formed by the discharge side end 14, male rotor 10, and female rotor 11. The screw compressor compresses gas or working fluids by utilizing tooth-space 21, wherein the tooth-space 21 lessens in volume as it shifts with the rotation of the male rotor 10 (shown on left-side in drawing).

Therefore, to reduce the tooth-space which is to be compressed, the starting position of compression is shifted from 100% rotor engagement to the direction of the arrow by an angle of rotation of α°. The present invention utilizes this principle, and adjusts the starting position of the sealing of the rotor engagement to the amount of capacity to be reduced. Then, the outer circumferential area of teeth of the male rotor is eliminated to an angle of rotation of α°, while the above described eliminated circular space 22 is used as a bypass 20 to return reduced airflow to the intake port.

That is, until the angle of rotation of the engaged rotors passes α°, reduced air flow is returned to intake port 17 via bypass 20, whereas once the angle of rotation of the engaged rotors passes α°, action of the rotors starts, and as the tooth-space is shutoff, compression is initiated.

The angle of rotation of α°, which is a basis for the amount reduced in the airflow rate reducing section, is computed by the capacity in proportion to the angle of rotation, as shown in FIG. 4. For example, according to FIG. 4, to reduce the capacity to 80%, the angle of rotation of α° is set around approximately 80° to 90°, and the outer circumferential area above the pitch circle 18 nearby the bottomland of the male rotor is eliminated stepwise to said angle (80° to 90°).

FIG. 5 shows the condition of the screw compressor in which the capacity of tooth-space 21 is reduced from 100% to a capacity corresponding to an angle of rotation of α°. Further, the capacity may be reduced in a wide range, by setting the angle of rotation to shorten the length of action.

As shown in the illustration, the outer circumferential area above the pitch circle 18 of the intake side end 15 nearby the bottomland of male rotor 10 is eliminated stepwise to an angle of rotation of α°, and the rotor shaft section 10*b* including the pitch circle 18 is left intact, so as to form an air flow rate reducing section. At the same time, a circular space 22 formed between the rotor shaft section 10*b* and the casing is utilized as a bypass 20 which bypasses working fluids such as gas to the intake port 17, as shown in FIG. 1 and FIG. 2.

According to the above described construction, until the male rotor passes the angle of rotation of α°, gas within the tooth-space is returned to the intake port 17 via bypass 20, whereas after the male rotor passes the angle of rotation of α°, the tooth-space is shutoff as compression starts, and the capacity is controlled to be 80%.

Further, the circular space 22 that forms the bypass 20 does not connect through with the reduced tooth-space, and thus, it does not affect the tooth-space and/or the succeeding processes of compression. Furthermore, by forming a large bypass 20 which connects through with the intake port 17, the tooth-space is enabled to be efficiently reduced from its full-capacity to a tooth-space 21, which corresponds to the prescribed capacity of reduction.

Moreover, in such a case in which the outer circumference of the rotor is to be eliminated, the outer circumference of teeth excluding the bottomland, is to be removed. For example, when eliminating the outer circumference of the male rotor, in a case in which the circumference is eliminated further below pitch circle 18 towards the center of the axis, the action ratio of the male and female rotor decreases. This decrease in the action ratio causes a hindrance of smooth rotation, as well as a rise in the surface pressure of torque transmission to rotate the driven rotor, and in order to prevent this condition, the outer circumferential area of teeth above the pitch circle excluding the bottomland is stepwisely eliminated.

FIG. 6 shows injected oil 23 being agitated by male rotor 10 and female rotor 11 of an oil injection type compressor. This agitation-loss is controlled by the following factors. That is, the agitation-loss is at an inverse proportion with the gap between rotor 10, rotor 11, and the inner surface of the outer circumference section 13 of the casing, and is in proportion with the length of agitation.

Generally, since the gap is set to be around 1/1000 of the radius of the rotor, in sections where the outer circumferential areas have been eliminated close to the pitch circle and rotor teeth, the loss of power accompanying oil agitation becomes an ignorable value, and enables the reduction of the shaft power.

EFFECTS OF THE INVENTION

According to the aforementioned description, the present invention accomplishes the following effects.

The full-load capacity can be controlled in a wide range without changing the measurement, shape, number of components, basic dimensions, and basic specifications of the compressor. In order to enable the above described control, only a minimum change in the shape of the components is necessary, the change being a process in which a section of the intake side end of one of the two rotors is eliminated towards the direction of the shaft.

Further, a change in the helix angle, which accompanies the conventional method of capacity adjustment of shortening the length of the rotor, is unnecessary; thus, a smooth drive of the compressor is enabled.

Furthermore, since the capacity of the tooth-space at the time of initiating the compressor is based on a theoretical substratum, an inefficient pressure-loss as seen in the conventional methods of capacity adjustment is prevented.

In the oil injecting type screw compressor, due to the shortening of the length of the oil agitator of the rotor, in comparison with the conventional methods of capacity adjustment and control, inefficient mechanical-loss is reduced.

What is claimed is:

1. A screw compressor for compressing working fluids by engaging a male rotor and a female rotor within a casing, wherein the screw compressor is an oil injecting type screw compressor in which a flow rate reducing section is provided by eliminating a part of a rotor engagement of one of the rotors from an intake side end towards a direction of a shaft; the one of the rotors is the male rotor of which a peripheral portion of each tooth radially outward from a pitch circle near the tooth base is eliminated to an axial distance corresponding to an angle of rotation α° from the intake side end in correspondence with a capacity amount to be reduced to form the flow rate reducing section in stepped shape leaving the rotor part including the pitch circle near the tooth base not eliminated; and a substantially annular space between the rotor part including the pitch circle and an inner circumferential face of the casing is composed as a bypass passage to the intake port.

* * * * *